US009889642B2

(12) United States Patent
Anderson et al.

(10) Patent No.: US 9,889,642 B2
(45) Date of Patent: Feb. 13, 2018

(54) MANAGING PRINTHEAD NOZZLE CONDITIONS

(71) Applicant: HEWLETT-PACKARD DEVELOPMENT COMPANY, L.P., Houston, TX (US)

(72) Inventors: Daryl E Anderson, Corvallis, OR (US); Eric T Martin, Corvallis, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 15/307,305

(22) PCT Filed: Jun. 11, 2014

(86) PCT No.: PCT/US2014/041860
§ 371 (c)(1),
(2) Date: Oct. 27, 2016

(87) PCT Pub. No.: WO2015/191060
PCT Pub. Date: Dec. 17, 2015

(65) Prior Publication Data

US 2017/0050429 A1 Feb. 23, 2017

(51) Int. Cl.
*B41J 2/165* (2006.01)
*B41J 2/21* (2006.01)
*B41J 2/045* (2006.01)

(52) U.S. Cl.
CPC ..... *B41J 2/0451* (2013.01); *B41J 2/04586* (2013.01); *B41J 2/16579* (2013.01);
(Continued)

(58) Field of Classification Search
CPC .. B41J 2/0451; B41J 2/04536; B41J 2/04561; B41J 2/04565; B41J 2/0458;
(Continued)

(56) References Cited

U.S. PATENT DOCUMENTS 4,590,482 A * 5/1986 Hay ..... B41J 2/125 347/19
6,375,299 B1 4/2002 Foster et al.
(Continued)

FOREIGN PATENT DOCUMENTS

WO WO-2013158099 10/2013
WO WO-2013158103 10/2013
WO WO-2013158105 10/2013

OTHER PUBLICATIONS

Wijshoff; Structure- and Fluid-dynamics in Piezo Inkjet Printheads; Jan. 25, 2008; http://doc.utwente.nl/58366/1/thesis_Wijshoff.pdf.

*Primary Examiner* — Anh T. N. Vo
(74) *Attorney, Agent, or Firm* — HP Inc. Patent Department

(57) ABSTRACT

In an example, a method of managing a nozzle condition test on a printhead includes instructing a printhead to perform impedance measurements on a plurality of nozzles in a first set of nozzles. The method also includes retrieving from the printhead, an impedance measurement result corresponding with each nozzle, where each impedance measurement result indicates a nozzle condition of its corresponding nozzle.

11 Claims, 7 Drawing Sheets

(52) U.S. Cl.
CPC ..... *B41J 2/2139* (2013.01); *B41J 2/2142* (2013.01); *B41J 2202/17* (2013.01)

(58) Field of Classification Search
CPC B41J 2/04586; B41J 2/14153; B41J 2/16579; B41J 2/2142; B41J 2/2139; B41J 29/393; B41J 2002/14354; B41J 2202/17; Y10T 29/49401
See application file for complete search history.

(56) References Cited

U.S. PATENT DOCUMENTS

| | | | | |
|---|---|---|---|---|
| 6,565,180 | B2 * | 5/2003 | Yu | B41J 2/0451 347/14 |
| 6,764,155 | B2 * | 7/2004 | D'Souza | B41J 2/04508 347/12 |
| 8,870,322 | B2 * | 10/2014 | Martin | B41J 2/0451 347/14 |
| 2002/0027575 | A1 | 3/2002 | Bruch et al. | |
| 2003/0090534 | A1 | 5/2003 | Valero et al. | |
| 2007/0046714 | A1 | 3/2007 | Beak et al. | |
| 2009/0189933 | A1 | 7/2009 | Nakano | |
| 2010/0026753 | A1 | 2/2010 | Kuroda et al. | |
| 2010/0165034 | A1 | 7/2010 | Devore et al. | |
| 2011/0084997 | A1 | 4/2011 | Chen et al. | |
| 2011/0148967 | A1 | 6/2011 | Schippers | |
| 2011/0285773 | A1 | 11/2011 | Shinkawa | |
| 2013/0278656 | A1 | 10/2013 | Govyadinov et al. | |

* cited by examiner

MANAGING PRINTHEAD NOZZLE CONDITIONS

BACKGROUND

Inkjet printing involves the release or ejection of printing fluid drops such as ink drops onto a print medium, such as paper. The ink drops bond with the paper to produce visual representations of text, images or other graphical content on the paper. In order to accurately produce the details of the printed content, nozzles in a printhead selectively release multiple ink drops as the relative positioning between the printhead and printing medium is precisely controlled. Over a period of time and use, the nozzles of the printhead may develop defects and therefore cease to operate in a desired manner. As a result, print quality may be adversely affected.

BRIEF DESCRIPTION OF THE DRAWINGS

Examples will now be described with reference to the accompanying drawings, in which.

Throughout the drawings, identical reference numbers designate similar, but not necessarily identical, elements.

DETAILED DESCRIPTION

Figure 1A:
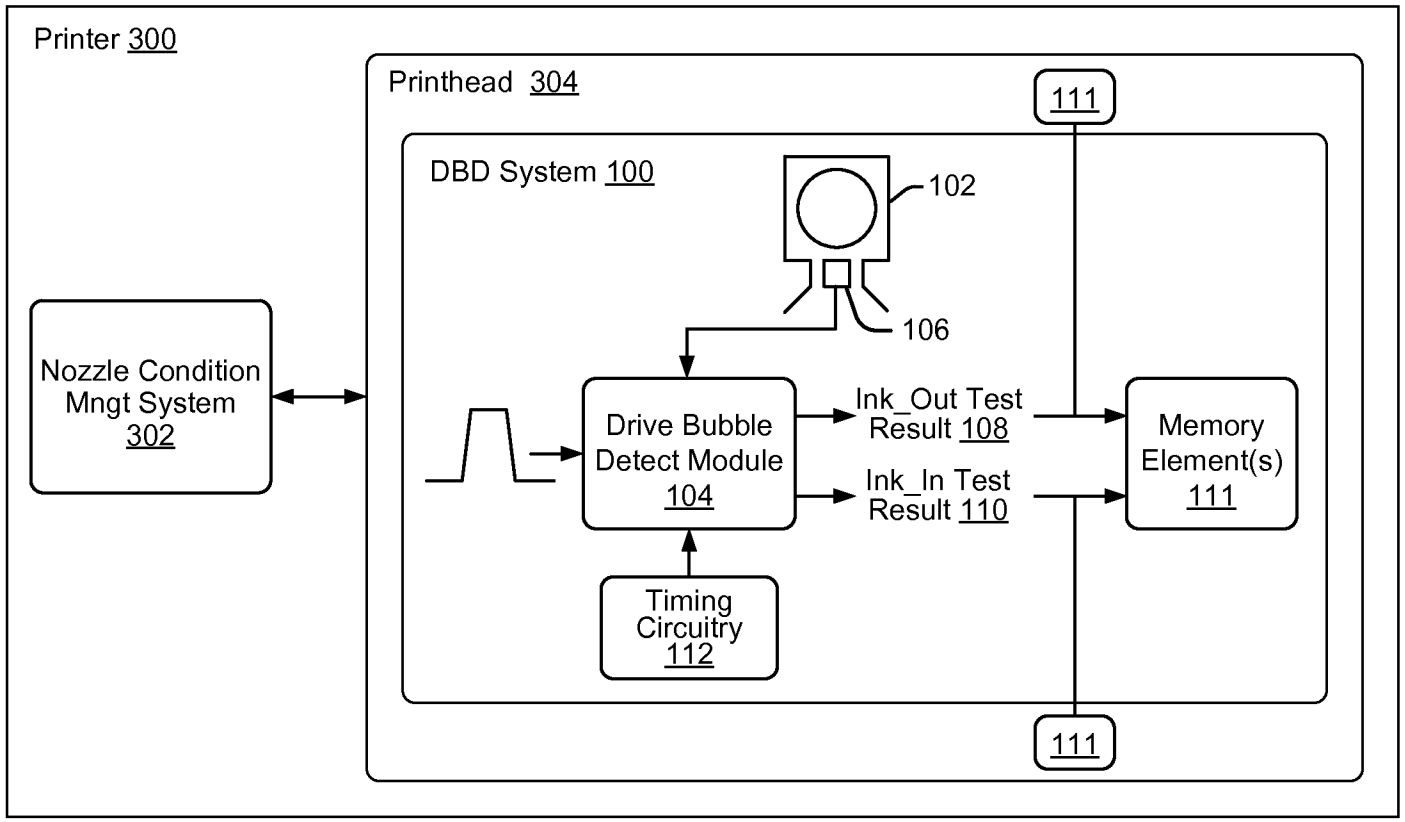
FIG. 1*a* shows a block diagram of an example printer implementing an example of a nozzle condition management system.

Systems and methods for evaluating and managing printhead nozzle conditions through drive bubble detection are described. Inkjet printing systems print image content onto a print medium, such as paper, by directing multiple drops of printing fluid, such as ink, onto the print medium. The ink is directed through multiple nozzles positioned on a printhead of the printing system as the printhead and print medium move relative to each other. For example, the printhead may move laterally with the print medium being conveyed through a conveying mechanism. Depending on the image content to be printed, the printing system determines the exact time instance and position at which the ink drops are to be released/ejected onto the print medium. In this way, the printhead releases multiple ink drops over a predefined area to produce a representation of the image content to be printed. Besides paper, other forms of print media may also be used.

A printhead releases/ejects ink drops through an array of nozzles provided on the printhead. The ink ejected through each nozzle comes from a corresponding ink chamber in fluid communication with the nozzle. The ink chamber is in fluid communication with an ink supply through ink delivery pathways within the printhead that enable the replenishment of ink within the chamber after each ink ejection. Each ink chamber holds the ink and periodically releases a predetermined amount to a corresponding nozzle for printing.

When a printhead is not printing, ink is retained within the ink chambers by capillary forces and/or back-pressures acting on the ink within the nozzle passages. Each ink chamber includes a heating element to generate heat within the chamber that causes small volumes of ink to expand and vaporize. The vaporization of ink results in the formation of a bubble within the ink chamber. The bubble, also referred to as a drive bubble, may further expand to drive or eject ink out of the chamber and through the nozzle passage. The ejected ink forms an ink drop that impacts the print medium to form an ink dot. As the ink drop is ejected, the bubble collapses and the volume of the dispensed ink drop is subsequently replenished within the chamber from an ink supply through ink delivery pathways within the printhead.

Ink nozzles are subjected to many such cycles of heating, drive bubble formation and collapse, and ink volume replenishments from an ink supply. Over a period of time, and depending on other operating conditions, ink nozzles within the printhead may become blocked or otherwise defective. Nozzle blockages can occur due to a variety of factors such as particulate matter within the ink that can cause the ink nozzle to get clogged. In some cases, small volumes of ink may solidify over the course of the printer's operation resulting in the clogging of the print nozzle. As a result, the formation and release of the ink drop may be adversely affected. Since the ink drop has to be formed and released at precise instances of time, any such blockages in the print nozzle are likely to have an impact on the print quality. Accordingly, in order to ensure that print quality is maintained, the condition of the print nozzle (i.e., whether it is blocked or whether it is experiencing other issues such as a deprimed chamber), is determined.

Various measures can be taken to help maintain nozzles in a healthy condition, such as nozzle servicing and nozzle replacement, for example. Such measures can be performed at different times, such as before printing begins, or during printing when print nozzles come to the end of a print swath, or when the media page is changing, and so on. The condition of a print nozzle can be monitored and determined through logical circuitry that can include a sensor in the nozzle chamber. The sensor can be used to detect the presence or absence of a drive bubble. For example, an ink volume present within the chamber of a print nozzle will offer less electrical impedance to a current provided by the sensor than will a drive bubble present within the chamber. When a drive bubble is present, air within the drive bubble offers a high resistance as compared to the resistance offered by the ink volume.

Depending on the impedance measurements and corresponding voltage variations due to the ink within the ink chamber, a determination can be made regarding whether or not a drive bubble has formed. Determining whether or not a drive bubble has formed can provide an indication about whether the print nozzle is operating in a desired manner. Furthermore, through the nozzle sensor, it may also be determined whether or not a drive bubble has formed at any specific instance or instances of time relative to the energizing of the firing resistor or heating element (i.e., relative to a fire pulse). For example, a blockage in the print nozzle can affect the formation of the drive bubble at a specific instance of time. If a drive bubble has not formed as expected at a particular instance of time, it can be determined that the nozzle is blocked and/or not working in the intended manner. Similarly, such a sensor-based mechanism can also determine whether or not a drive bubble has collapsed at a specific instance of time. Upon collapse of the drive bubble, the ink has usually been replenished, and this condition can be detected by the nozzle sensor. If it is determined that the drive bubble has not collapsed at a predetermined or expected instance of time, it can further be determined that the nozzle has become defective in some manner.

The printhead can incorporate circuitry that assists in implementing the functionality of the printhead. The sensor based mechanisms as described above, may operate based on signals generated by the sensors. Such signals can be communicated off the printhead circuitry, or off-chip, or off the printhead die. However, communicating such signals off the printhead to a printer (e.g., a processor or other components of the printer) to determine the condition of the print nozzle, consumes bandwidth and can introduce timing issues that might affect the accuracy of such determinations. Furthermore, processing such signals on the printhead die by prior known methods would involve complex circuitry that uses excessive die space and adds significant cost.

Accordingly, example drive bubble detect (DBD) test systems and methods have been developed that implement minimal circuitry on-chip (i.e., on the printhead die) to test for and store printhead nozzle conditions by detecting the presence and absence of drive bubbles within nozzle ink chambers. Determinations about nozzle conditions are performed on-chip, which reduces the demand on bandwidth for communicating condition-related information to different components of the printer, and reduces computation overhead on the printer processing unit. The minimal circuitry can be implemented using a plurality of logic-based components that reduce system complexity.

An example DBD test system includes a sensor within a nozzle chamber. The sensor can be an impedance sensor to determine variations in impedance of a sensed medium that changes between ink and air within the nozzle ink chamber as drive bubbles form and collapse. The impedance depends on the current passing from the sensor to ground (e.g., a ground within the print nozzle ink chamber or other locations that are in contact with the ink) through the sensed medium, and it can be compared to a threshold to determine nozzle conditions. The nozzle chamber includes a heating element, and during a printing operation the heating element causes the print nozzle to release or fire/eject ink drops onto a print medium to print desired image content. The release of an ink drop can be based on a signal, referred to as a firing pulse, received from a print processor. A fire pulse provides an indication to the print nozzle to fire or release an ink drop onto the print medium, and it results in energy being applied to the heating element to effectuate the firing of the ink drop. Energy from a fire pulse activates the heating element to generate heat, which causes a drive bubble to form within the ink chamber. As the drive bubble expands, it forces an ink drop out of the chamber and through the ink nozzle. Once the ink drop is ejected, the drive bubble collapses and the volume of ink ejected is replenished within the chamber by an ink supply reservoir in preparation for subsequent firing.

As the drive bubble forms and collapses within the chamber, variations in impedance can occur, and the different impedance values can be measured through the sensor positioned within the print nozzle. The varying values of impedance can be measured at specific instances of time following the end of the firing pulse (i.e., either the rising edge or the falling edge of the firing pulse). For example, impedance values can be measured at a first predetermined time instant and at a second predetermined time instant following the end of the firing pulse. The impedance values can be compared with predefined threshold values to determine whether or not the print nozzle is functioning properly or in a healthy condition.

For example, the first predetermined time instant may correspond to a time after the end of the firing pulse at which a drive bubble is expected to have formed. If the impedance measured at such a first predetermined time instant is high, in correspondence with a predefined threshold, it may be concluded that ink is out of the nozzle and the drive bubble has formed in an appropriate manner. However, if impedance variations occur at the first predetermined time instant (e.g., the measured impedance value increases from low to high with respect to a threshold), it may be concluded that the print nozzle is blocked. Similarly, if the measured impedance at the first predetermined time instant varies from high to low, it may be concluded that the drive bubble formed is a weak drive bubble. In addition, if the impedance measured at such a first predetermined time instant is low, which is not in correspondence with a predefined threshold, it may be concluded that no drive bubble has formed and that there may be an issue with the heating element, ink nozzle, or nozzle chamber.

After an ink drop is ejected from the print nozzle, the drive bubble collapses and the volume of ink expended by the print nozzle is replenished within the ink chamber through an ink supply reservoir. As a result, the sensor is brought back into contact with ink at a second predetermined time instant following the end of the fire pulse (e.g., the falling edge of the firing pulse). Thus, at the second predetermined time instant, a measured impedance should have changed from a high value (i.e., before drive bubble collapse) to a low value (i.e., after drive bubble collapse). If the measured impedance at the second predetermined time instant is at a low value that corresponds with a predefined threshold, it may be concluded that ink is back in the nozzle and the print nozzle is functioning properly. However, if the measured impedance at the second predetermined time instant is not a low value that corresponds with a predefined threshold, it may be concluded that the print nozzle is not functioning properly. In such a case, the print nozzle may be blocked or it may have a stray bubble present.

Measured impedance values and impedance variations associated with the print nozzle can be converted to one or more logical output signals, for example, in the form of a binary output. The logical output signals are obtained by processing the signals associated with the impedance variations through minimal logical circuitry provided on the printhead. The logical output signals are subsequently stored, registered, or latched, onto the components of the minimal circuitry to indicate the condition of the print nozzle. For example, the logical output signals represented as a combination of 0's and 1's, can be mapped to different indicative conditions of the print nozzle. The circuitry for determining the condition of the print nozzle can be implemented on the printhead using a plurality of simple logical-based components. Thus, further processing of the logical output signals off the printhead to determine a nozzle condition is unnecessary, and the use of resources to communicate and process signals indicating print nozzle conditions may be avoided. In an example, the minimal circuitry implemented on the printhead die can register the logical output signals at the first predefined time interval and the second predefined time interval. Based on the measured impedances and resulting logical output signals, the condition of the print nozzle can be recorded or stored on the printhead. The logical output signals can be a series of 0's and 1's that indicate whether the condition of the print nozzle is healthy or not (i.e., whether the nozzle is functioning properly). In some examples, logical output signals based on impedance measurements of multiple nozzles from a set of nozzles can be combined (e.g., logically OR'ed) together to determine if all nozzles in the set of nozzles are functioning properly, or conversely, to determine if at least one nozzle of the set of nozzles is not functioning properly. In some examples, the logical output signals can indicate additional information such as the time elapsed between the firing pulse and the formation of a drive bubble (i.e., ink out of the nozzle), and/or the time elapsed between the firing pulse and the collapse of the drive bubble (i.e., ink back in the nozzle).

Accordingly, example DBD test systems on a printhead can determine and store nozzle conditions on the printhead using minimal logical circuitry to detect the presence and absence of drive bubbles within nozzle ink chambers (e.g., through impedance measurements). Furthermore, example nozzle management systems and methods on a printer are disclosed herein that provide nozzle condition management through controlling such printhead-based DBD systems. Such printer-based management systems provide for the evaluation of, and potential response to, nozzle conditions that have been determined and stored on the printhead by a printhead-based DBD test system. In some examples, DBD testing of nozzles on the printhead is fully controlled by the printer. The printer can control when DBD tests are performed, such as before, during, and after a print job is processed. For example, the printer can control DBD tests to occur in time periods between printing print swaths, or time periods between printing media pages, or time periods before or after printing the print job. The printer can set the printhead into a DBD test mode, for example, by enabling various DBD circuitry on the printhead. The printer can send a full fire pulse group to the printhead to fire specific nozzles comprising a nozzle set (e.g., firing one nozzle from each nozzle column). The printer can wait for a short period of time as the DBD circuitry stores test results (i.e., nozzle conditions) in registers (i.e., one register per nozzle column) on the printhead, and thereafter the printer can read or retrieve the DBD results from the registers over a communication bus. In some examples, the DBD circuitry can store test results in a single, cumulative register on the printhead to indicate when at least one nozzle is not functioning properly, and the printer can read a single result from the single cumulative register to determine if at least one nozzle from a nozzle set is not functioning properly. In some examples, the printer repeats the process for some or all nozzle sets. In other examples, the printer can repeatedly execute the DBD tests on a static nozzle set. In this case, the same nozzle set can be repeatedly tested and the printer can periodically read the DBD test results from printhead registers.

In some examples, upon evaluating nozzle conditions (i.e., DBD test results) from a nozzle set, the printer can provide varying responses. For example, in the case where an evaluation of nozzle conditions from a DBD-tested nozzle set indicates that a nozzle or multiple nozzles are not functioning properly, the printer can respond by repeating the DBD tests on the same nozzle set. This enables the printer to monitor the condition of a nozzle that has not functioned properly and to determine if repeated firing of the nozzle during the DBD tests can resolve issues within the nozzle. For example, if a nozzle has an air bubble in its chamber that causes it to not function properly during a first nozzle firing, subsequent repeated nozzle firings can often resolve this problem through elimination of the air bubble. In other cases, where an evaluation of nozzle conditions from a DBD-tested nozzle set indicates that all the nozzles in the nozzle set are functioning properly, the printer can respond by running DBD tests on nozzles within a next nozzle set.

The above methods and systems are further described with reference to FIGS. 1 through 6. It should be noted that the description and figures merely illustrate the principles of the present subject matter. It is thus understood that various arrangements may be devised that, although not explicitly described or shown herein, embody the principles of the present subject matter. Moreover, all statements herein reciting principles, aspects, and examples of the present subject matter, are intended to encompass equivalents thereof.

Figure 2:
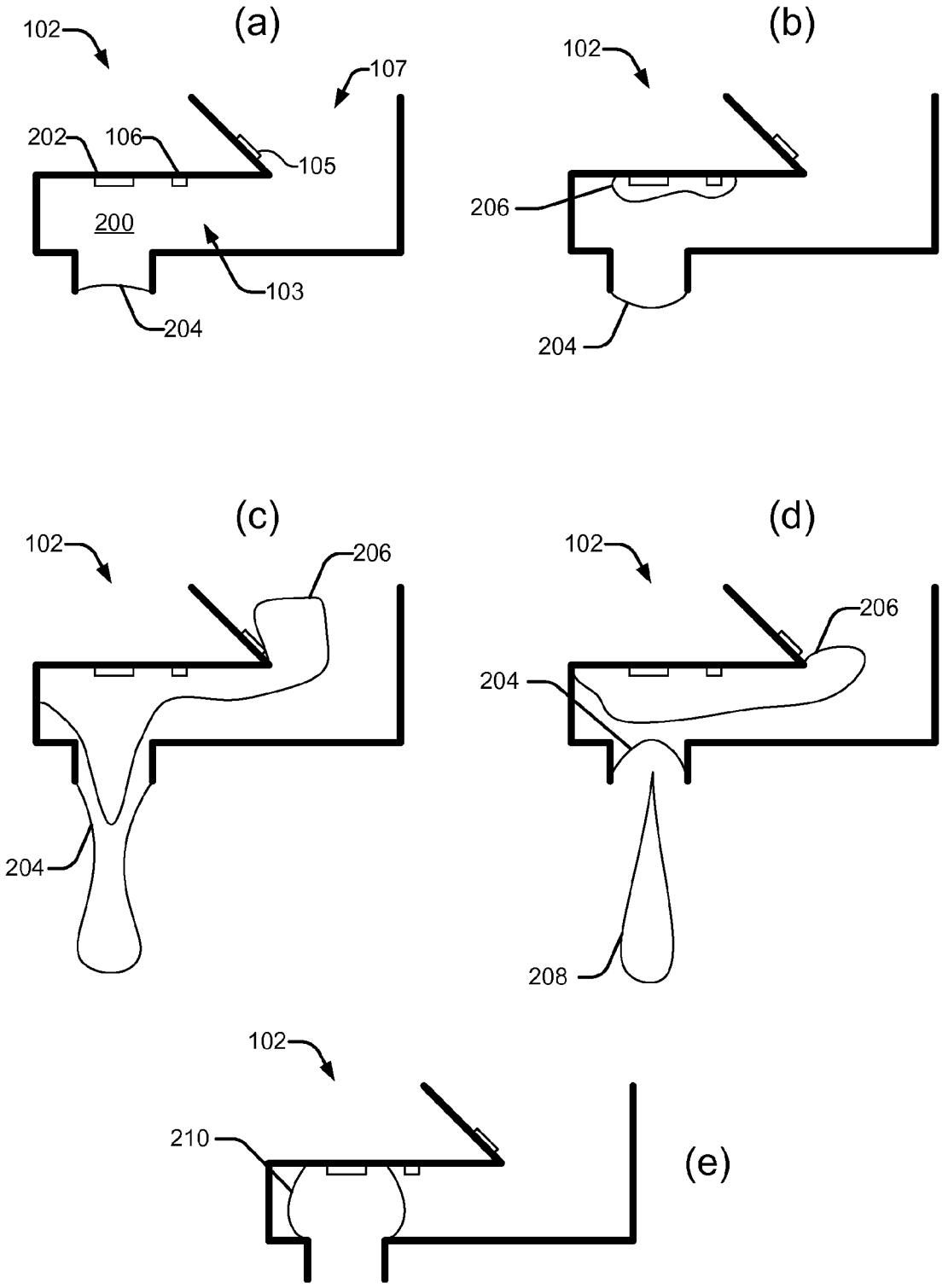
FIG. 2 shows an example print nozzle depicting an example process of the formation and collapse of a drive bubble.

FIG. 1*a* illustrates a block diagram of an example printer 300 implementing an example of a nozzle condition management system 302. The management system 302 manages testing and evaluation of printhead nozzles by controlling a drive bubble detect (DBD) test system 100 on the printhead 304 that determines printhead nozzle conditions through detecting the presence and absence of drive bubbles within the nozzles. The DBD system 100 is implemented within circuitry of the printhead of printer 300. The DBD system 100 includes a print nozzle 102 coupled to a DBD module 104. Further details of print nozzle 102 are shown in FIG. 2, which depicts the formation and collapse of a drive bubble within the nozzle 102 as discussed in greater detail below. Referring to FIGS. 1*a* and 2, a sensor 106 is provided within the ink chamber 103 of the print nozzle 102. The sensor 106 can be implemented, for example, as an impedance sensor or a voltage sensor. In some examples, the sensor 106 can include a metal plate, such as a metal plate made of tantalum, copper, nickel, titanium, or combinations thereof. A ground element 105 may also be located anywhere within the ink chamber 103 or ink reservoir 107. In the example of FIG. 2, the ground element 105 is depicted in the ink reservoir 107. In some examples, the ground element 105 is an etched portion of a wall with a grounded, electrically conductive material that is left exposed. In other examples, the ground element 105 may be a grounded electrical pad. In the presence of liquid ink 200, a voltage can be applied to the impedance sensor 106 and an electrical current can pass from the sensor 106 to the ground element 105.

In general, the sensor 106 measures the variations in impedances that occur due to the formation or collapse of a drive bubble within the nozzle chamber at specific instants of time. Based on the measured impedances, the DBD module 104 provides output test results as logical signals, referred to as ink_out test result 108 and ink_in test result 110. In some examples, the DBD module 104 makes the ink_out test result 108 and ink_in test result 110 available to the printer's nozzle condition management system 302 for retrieval and evaluation. For example, the DBD module 104 can place the ink_out test result 108 and ink_in test result 110 on output pads 109 of the printhead 304, or store the results in a memory element 111 (e.g., latch, storage register) of the DBD system 100 on the printhead 304. In one example, the sensor 106 measures an impedance associated with the nozzle chamber 103. More specifically, the sensor 106 measures the impedance or the voltage by passing a current from the sensor 106 to ground 105 through the ink volume 200 present within the nozzle chamber 103. Since the ink 200 is a conducting medium, the ink provides less impedance to a current than the air in a drive bubble. Once the drive bubble is formed, the impedance offered would be high. Consequently, the voltage associated with the nozzle chamber 103 would be low and high, respectively.

A printing process can be initiated through a firing pulse. Upon receiving the firing pulse, a heating element 202 within the print nozzle 102 can start heating the ink, which results in the formation of a drive bubble. Prior to the formation of the drive bubble, the ink will be in contact with the sensor 106 and will provide a low impedance. Once the drive bubble has formed, however, the ink ceases to be in contact with the sensor 106 and the measured impedance will be high.

The DBD module 104 determines the impedance at certain time instants. The timing for measuring the impedances is managed and controlled by timing circuitry 112. The time instants are determined after a predefined time has elapsed from the occurrence of the firing pulse. In one example, the DBD module 104 measures the impedance at time instants prescribed by a first predetermined time instant and second predetermined time instant.

While measuring the impedance associated with the nozzle chamber, the DBD module 104 may compare the measured impedance with respect to a threshold impedance, at the first predetermined time instant. In one example, the timing circuitry 112 may activate the DBD module 104 so that the measured impedance is captured or registered at the occurrence of the first predefined time instant. The DBD module 104 may include one or multiple memory elements 111 (e.g., latches or storage registers) for storing the result of the comparison.

For a properly functioning print nozzle, a drive bubble will form by the first predetermined time instant. Consequently, the measured impedance associated with the print nozzle 102 (i.e., the nozzle chamber 103) should be high. If the DBD module 104 determines that the impedance variation has occurred by the first predetermined time instant, it may be concluded that the drive bubble either did not form properly, or was weak (e.g., collapsed prematurely). On the other hand, if the DBD module 104 determined that the impedance measured was high and no variations in the measured impedance occurred with respect to the threshold impedance, the print nozzle 102 would be considered as healthy and functioning properly. The determination of the DBD module 104 may be represented as a test result. Since the present test result corresponds to a state where the ink flows out of the print nozzle 102 (i.e., ink is pushed out by the drive bubble), the test result may be referred to as an ink_out test result 108.

The DBD module 104 can also compare the measured impedance with respect to the threshold impedance at the second predetermined time instant. In one example, the timing circuitry 112 can activate the DBD module 104 so that the measured impedance is captured or registered at the occurrence of the second predefined time instant. The DBD module 104 may include a second set of memory elements 111 (e.g., latches or registers) for storing and providing the outcome of the comparison.

For a properly functioning print nozzle, a drive bubble will collapse after the second predetermined time instant. Consequently, the impedance measured would vary from high to low as the ink flows in from a reservoir and replenishes the ink volume within the ink chamber 103. If the DBD module 104 determines that the impedance variation has occurred by the second predetermined time instant, it may be concluded that the drive bubble collapsed properly, and that the ink supply within the print nozzle was replenished in a timely manner. If however, the DBD module 104 determines that the variation occurs beyond the second predetermined time instant, it may be concluded that the print nozzle 102 is not functioning properly. For example, the print nozzle 102 may be blocked or a stray drive bubble may be present within the nozzle. In such a case, the DBD module 104 provides the result of such a determination as an ink_in test result 110.

In order to evaluate the condition or health of the print nozzle 102, both the ink_out test result 108 and the ink_in test result 110 can be used. For example, when both ink_out test result 108 and the ink_in test result 110 indicate that the drive bubble has formed and collapsed in a timely manner, the print nozzle 102 will be considered as healthy or as functioning properly. In another example, as discussed below, the ink_out test result 108 and the ink_in test result 110 may be stored on the printhead 304 in a register 111 of the DBD system 100 and communicated to (e.g., retrieved by, or read by) a processing unit of the printer (e.g., the printer's nozzle condition management system 302) for further implementing a remedial action or other response. The ink_out test result 108 and the ink_in test result 110, in one example, may be in a binary form.

Figure 1B:
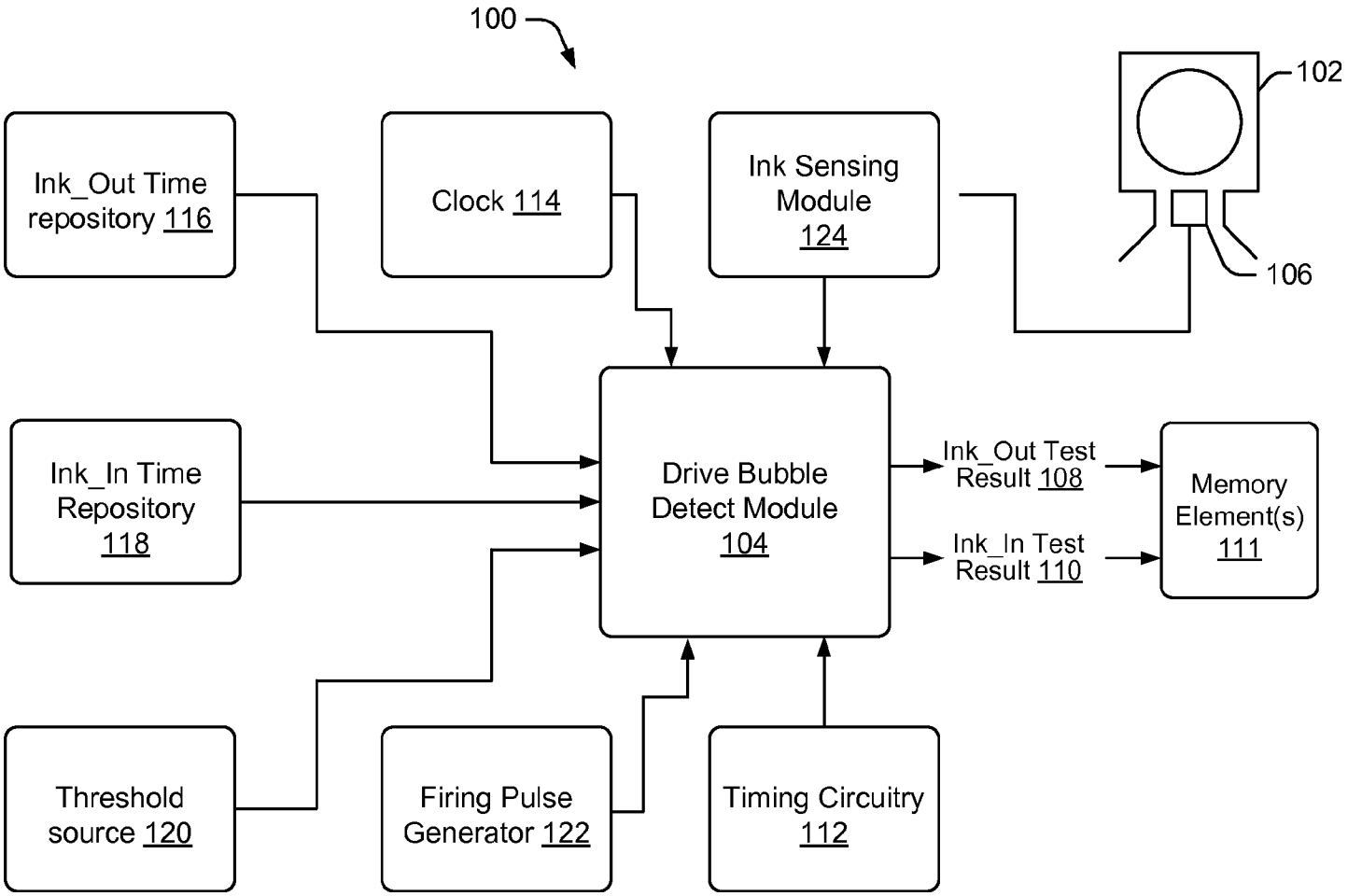
FIG. 1*b* shows additional details of an example drive bubble detect test system for determining printhead nozzle conditions.

FIG. 1*b* illustrates additional details of an example DBD test system 100 for determining printhead nozzle conditions. The DBD system 100 as described is implemented within circuitry of a printhead installed, for example, in a printer. The system 100 includes a print nozzle 102 coupled to a DBD module 104. The print nozzle 102 further includes a sensor 106 provided within the print nozzle 102. In one example, the sensor 106 is a capacitive sensor configured to measure either impedance or voltage associated with the nozzle chamber 103. The system 100 further includes timing circuitry 112, a clock 114, ink_out time repository 116, ink_in time repository 118, threshold source 120, a firing pulse generator 122 and an ink sensing module 124. Each of the above mentioned modules is coupled to a DBD module 104. Although not explicitly represented, each of the modules may be further connected to each other. The DBD module 104 provides ink_out test result 108 and ink_in test result 110 based on inputs received from the modules as illustrated.

The operation of system 100 can be explained in conjunction with FIG. 2. As noted above, FIG. 2 provides an illustration of an example print nozzle 102 depicting an example process of the formation and collapse of a drive bubble. As shown in the FIG. 2 example, the print nozzle 102 includes a heating element 202 and the sensor 106. Through the action of the heating element 202, the sensor 106 may monitor the variations in the impendence measured across the print nozzle 102 due to the formation of the drive bubble 206.

Initially, the print nozzle 102 prepares for ejecting an ink drop based on a fire pulse received from the firing pulse generator 106. Prior to receiving the firing pulse, the ink 200 is retained within the print nozzle 102 due to capillary action, with the ink level 204 contained within the print nozzle 102. Upon receiving the firing pulse, the heating element 202 initiates heating of the ink in the chamber 103 of the print nozzle 102. As the temperature of the ink in the proximity of the heating element 202 increases, the ink vaporizes and forms a drive bubble 206. As the heating continues, the drive bubble 206 expands and forces the ink level 204 to extend beyond the print nozzle 102 (as shown in FIGS. 2(*a*)-(*c*)).

As previously noted, ink within the print nozzle chamber 103 offers certain electrical impedance to electrical current. Ink is typically a good conductor of electric current, and the electrical impedance offered by the ink in the nozzle chamber 103 is therefore less than for other mediums such as air. As the print nozzle 102 prepares for ejecting an ink drop, the sensor 106 may pass a finite electrical current through the ink to a ground 105 within the nozzle chamber 103. The electrical impedance and/or the voltage associated with the print nozzle 102 can be measured through the sensor 106.

The following example is presented with respect to an impedance measurement associated with the print nozzle 102. As a drive bubble 206 forms due to the action of the heating element 202, the ink in the proximity of the sensor 106 can lose contact with the sensor 106. As the drive bubble 206 forms, the sensor 106 can become completely surrounded by the drive bubble 206. At this stage, since the sensor 106 is not in contact with the ink, the impedance, and therefore the voltage measured by the sensor 106 would be correspondingly high. The impedance measured by the sensor 106 would register a mostly constant value during the time interval the sensor 106 is not in contact with the ink. As the drive bubble 206 expands further, the physical forces arising out of the capillary action are no longer able to hold the ink level 204, and an ink drop 208 is formed and then separates from the print nozzle 102. The separated ink drop 208 is thus ejected toward the print medium. Once the ink drop 208 is ejected, ink in the chamber 103 of print nozzle 102 is replenished by the incoming ink flow from a reservoir 107. At this stage the heating element 202 stops heating, and as the ink is replenished, the drive bubble 206 collapses resulting in a shrinking bubble space 210 that restores ink contact with the sensor 106, as shown in FIG. 2(*e*).

The sensor 106 can measure the variations in the impedance and/or voltage that occur during the course of drive bubble 206 formation and collapse. The impedance (and voltage) associated with the print nozzle 102 will remain low at instants when ink is present and the drive bubble 206 is not present, and will be high when the drive bubble 206 is present. During the formation and collapse of the drive bubble 206, the impedance measured by the ink sensing module 124 will vary. In some examples, the variations in impedance associated with the print nozzle 102 are measured by the ink sensing module 124 at specific time instants. The specific time instants are measured after a predefined time has elapsed following the occurrence of a firing pulse. The specific time instants can represent time instants following a firing pulse when a drive bubble (or, conversely, ink) is expected and not expected to be present within the print nozzle 102.

In one example, the specific time instants may include a first predetermined time instant and a second predetermined time instant. The first predetermined time instant may correspond to a point in time when the drive bubble 206 has formed (i.e., when ink has been or is in the process of being dispensed from the print nozzle 102). The first predetermined time instant can be referred to as an ink_out time. Furthermore, at the second predetermined time instant, after the drive bubble 206 fully expands and the ink drop is dispensed from the print nozzle 102, the drive bubble 206 will collapse and allow replenishment of the ink within the chamber 103, which will restore ink contact with the sensor 106. Because ink flows into the print nozzle 102 at this stage, the second predetermined time instant can be referred to as the ink_in time. The ink_in time and the ink_out time can be stored within ink_out time repository 116 and ink_in time repository 118, respectively.

The DBD module 104 can determine the impedance at the first and second predetermined time instants. In general, for a properly functioning print nozzle 102, the impedance associated with the nozzle will decrease over a period of time covering the two time instants, varying from a higher impedance at the first time instant (when the drive bubble is present), to a lower impedance at the second time instant (when the drive bubble has collapsed). The impedance associated with the nozzle 102 is measured after the firing pulse has been initiated. In one example, the impedance can be measured with respect to the falling edge of the firing pulse. Thus, when the falling edge of the firing pulse occurs, the ink sensing module 124 measures the impedance associated with the print nozzle 102. In one example, when the falling edge of the firing pulse occurs, the drive bubble 206 may have formed, or may be in the process of being formed. At this stage, the ink within the print nozzle 102 is not in contact with the sensor 106. As a result, the measured impedance would be correspondingly high. The DBD module 104 subsequently obtains the ink_out time from the ink_out time repository 116. As mentioned previously, the ink_out time specifies the time at which the drive bubble 206 would have formed for a properly functioning print nozzle 102.

Upon obtaining the ink_out time from the ink_out time repository 116, the DBD module 104 obtains the impedance associated with the print nozzle 102 from the ink sensing module 124. The DBD module 104 then determines and compares the impedance associated with the print nozzle 102 at the instant prescribed by the ink_out time, with a threshold impedance. Depending on whether the impedance is high, the DBD module 104 may determine whether the print nozzle 102 is functioning properly. For example, an impedance associated the print nozzle 102 that is less than the threshold impedance would indicate that the drive bubble 206 either formed late or did not form at all, which in turn would indicate that the print nozzle 102 is blocked. The ink_out time is determined with respect to the instance when the falling edge of the firing pulse occurs. In one example, the time elapsed from the instance of the falling edge of the firing pulse, may be measured through a clocked signal provided by the clock 114. In another example, the DBD module 104 provides an output indicating the determination for the ink_out time as ink_out test result 108.

As noted, the drive bubble 206 should continue to expand until an ink drop 208 is formed and ejected from the print nozzle 102. When the ink drop 208 is ejected, the drive bubble 206 should collapse and the ink should again come in contact with the sensor 106. As a result, the measured impedance associated with the print nozzle 102 should also drop. The DBD module 104 determines whether the expected variation in the impedance occurs, by determining if the measured impedance is lower than the threshold impedance at a second predefined time instant. In one example, the DBD module 104 determines whether the impedance variation occurring due to the collapsing of the drive bubble 206, occurs by the time instant prescribed by the ink_in time. The ink_in time may be obtained from the ink_in time repository 118.

Based on the impedance determined at the ink_in time, the DBD module 104 determines whether the print nozzle 102 is functioning properly. For example, if the impedance associated with the print nozzle 102 does not change (i.e., remains high), it may be concluded that the drive bubble 206 has persisted within the print nozzle 102 for a longer time period. This typically occurs when an ink drop takes a longer time to form, which is often the result of a blocked nozzle. Ink drops can also take a longer time to form when a stray bubble has formed within the print nozzle 102.

In another example, if the DBD module 104 determines that the impedance associated with the print nozzle 102 is less than the threshold impedance at the ink_in time, it may be concluded that the print nozzle 102 is functioning properly. In one example, the DBD module 104 provides an output indicating the determination for the ink_in time as ink_in test result 110. In one example, both the ink_out test result 108 and the ink_in test result 110 are considered for determining whether the print nozzle 102 is functioning in the proper manner. In another example, the impedance associated with the print nozzle 102 may be determined with respect to a threshold impedance, provided by threshold source 120.

In yet another example, the timing circuitry 112 may be employed for measuring impedances at the ink_out time instant and the ink_in time instant. In such a case, the timing circuitry 112 may measure the time that as elapsed from the occurrence of the firing pulse based on a clocked signal from clock 114. Once the time as prescribed by the ink_out time has been reached, the timing circuitry 112 may activate the DBD module 104 to determine a logical output based on the impedance measured at the ink_out time instant. The logical output may be determined based on the comparison between the impedance measured and a threshold impedance.

The logical output may be registered within the DBD module 104 as the ink_out test result 108. In another example, the DBD module 104 may further store the ink_out test result 108 in a memory element 111 (e.g., latch, register). Similarly, the timing circuitry 112 may also monitor the time using the clocked signal from clock 114. As the time instant prescribed by the ink_in time occurs, the timing circuitry 112 may further activate the DBD module 104 to determine another logical output and store the same. In an example, the other logical output may be stored as the ink_in test result 110.

Figure 3:
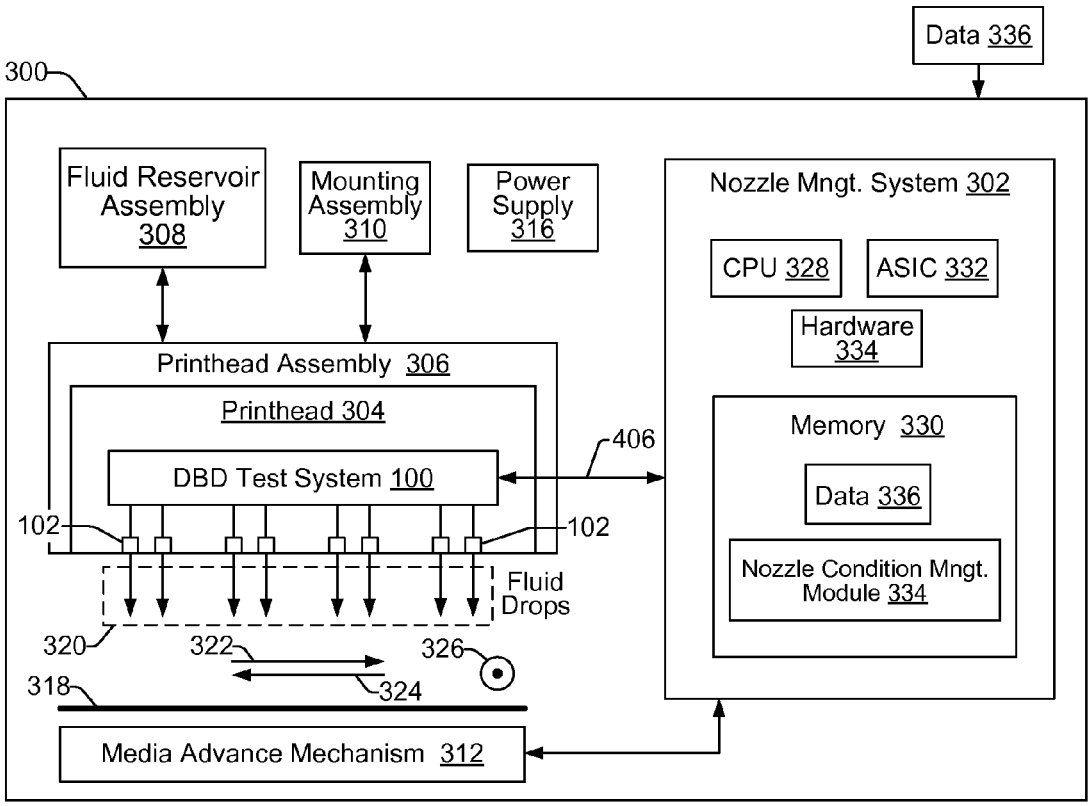
FIG. 3 shows a block diagram of an example printer suitable for implementing an example nozzle condition management system to manage testing and evaluation of printhead nozzles.

FIG. 3 illustrates a block diagram of an example printer 300 suitable for implementing an example nozzle condition management system 302 to manage testing and evaluation of printhead nozzles by controlling a DBD test system 100 on a printhead 304. In this example, printer 300 includes an inkjet printhead assembly 306, a fluid reservoir assembly 308, a mounting assembly 310, a media advance mechanism 312, nozzle management system 302, and a power supply 316 that provides power to the various electrical components of printer 300. Inkjet printhead assembly 306 includes one or multiple printheads 304, each having at least one printhead die to eject drops of printing fluid through a plurality of nozzles 102 toward a media page 318 so as to print onto the media page 318. A media page 318 can be, for example, a precut media sheet from a media tray or a continuous media web supplied by a media roll of media from an unwinding media advance mechanism. Typically, nozzles 102 are arranged in columns or arrays such that properly sequenced ejection of ink from nozzles 102 causes characters, symbols, and/or other graphics or images to be printed upon a media page 318 as inkjet printhead assembly 306 and the media page 318 move relative to each other.

In some examples, fluid reservoir assembly 308 supplies printing fluids to printhead assembly 306 and can include reservoirs to store and supply different printing fluids to a printhead 304. For example, reservoir assembly 308 can include reservoirs to supply different colored inks (e.g., cyan, magenta, yellow, and black) for different ink slots on a printhead 304. In some examples, inkjet printhead assembly 306 and all or part of a fluid reservoir assembly 308 can be housed together in a print cartridge or pen. In some examples, individual reservoirs within reservoir assembly 308 can be removed, replaced, and/or refilled.

Mounting assembly 310 positions inkjet printhead assembly 306 with printhead 304 relative to media advance mechanism 312, and media advance mechanism 312 positions media page 318 relative to inkjet printhead assembly 306. Thus, a print zone 320 is defined adjacent to nozzles 102 in an area between inkjet printhead assembly 306 and media page 318. In one example, printer 300 is a scanning type printer. In a scanning type inkjet printer 300, mounting assembly 310 comprises a carriage that conveys inkjet printhead assembly 306 back and forth across the width of a print media page 318 in a manner indicated by direction arrows 322 and 324. Thus, inkjet printhead assembly 306 moves in a generally horizontal manner that is orthogonal to the media advance direction 326.

Nozzle management system 302 of printer 300 generally includes a processor (CPU) 328, a memory 330, firmware, and other printer electronics for communicating with and controlling inkjet printhead assembly 306, mounting assembly 310, and media advance mechanism 312. In some examples, nozzle management system 302 may also include an ASIC 332 (application specific integrated circuit) and/or additional hardware components 334 to perform certain operations of the printer 300 alone or in combination with a processor 328 executing program instructions as discussed below. Thus, hardware components 334 can include physical components such as programmable logic arrays (PLAs), programmable logic controllers (PLCs), other logic and electronic circuits, and/or combinations of such physical components with programming executable by a processor.

Memory 330 can include both volatile (i.e., RAM) and nonvolatile (e.g., ROM, hard disk, optical disc, CD-ROM, magnetic tape, flash memory, etc.) memory components. The memory components of a memory 330 comprise non-transitory machine-readable (e.g., computer/processor-readable) media that provide for the storage of machine-readable coded program instructions, data structures, program instruction modules, and other data for printer 300, such as module 334. The program instructions, data structures, and modules stored in memory 330 may be part of an installation package that can be executed by processor 328 to implement various examples, such as examples discussed herein. Thus, memory 330 may be a portable medium such as a CD, DVD, or flash drive, or a memory maintained by a server from which the installation package can be downloaded and installed. In another example, the program instructions, data structures, and modules stored in memory 330 may be part of an application or applications already installed, in which case memory 330 may include integrated memory such as a hard drive. As noted, components of memory 330 comprise a non-transitory medium that does not include a propagating signal.

Nozzle management system 302 can receive print data 336 from a host system, such as a computer, and store the data 336 in memory 330. Typically, data 336 comprises RIP (raster image processor) data that is in an appropriate image file format (e.g., a bitmap) suitable for printing by printer 300. Data 336 represents, for example, a document or image file to be printed. As such, data 336 forms a print job for printer 300 that includes print job commands and/or command parameters. Using data 336, nozzle management system 302 controls inkjet printhead assembly 306 to eject imaging fluid drops from nozzles 102 to form characters, symbols, and/or other graphics or images on media page 318.

Figure 4:
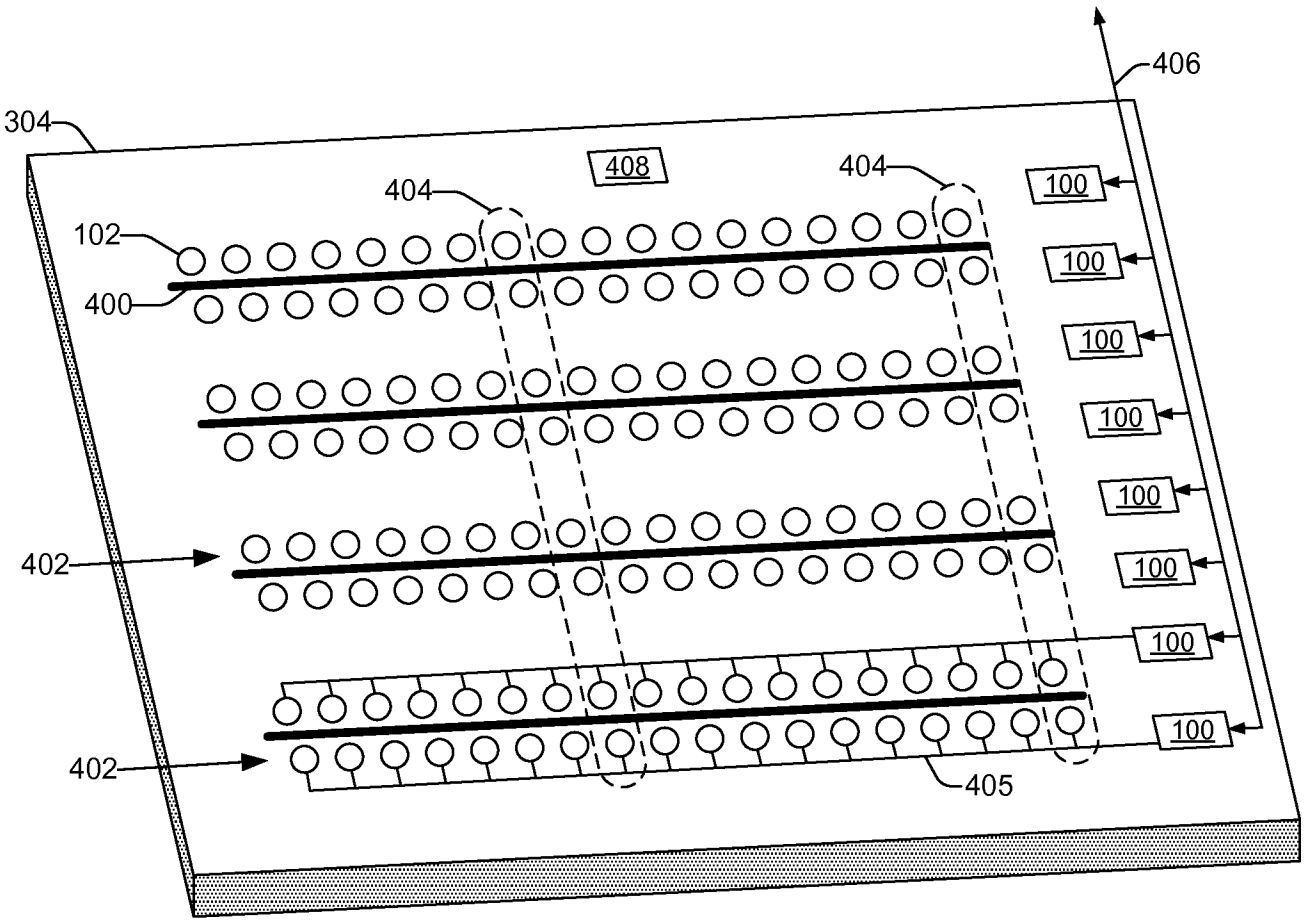
FIG. 4 shows an example printhead that is suitable for implementing a drive bubble detect test system.

Referring now to FIG. 4, an example printhead 304 suitable for implementing a DBD test system 100 is illustrated. As shown in FIG. 4, printhead 304 includes four fluid ink slots 400, with each slot 400 supplying fluid ink to two nozzle columns 402 on either side of the slot 400. Therefore, in this example, printhead 304 includes eight nozzle columns 402, and each slot 400 can provide a different ink color (e.g., cyan, magenta, yellow, black) to two of the eight nozzle columns that are adjacent to either side of the slot 400. In some examples, a printhead 304 can have a greater or lesser number of slots and corresponding nozzle columns. Each nozzle column 402 represents a group of nozzles from which a single nozzle can be included within a nozzle set 404 for DBD testing. This is because a common result bus 405 is coupled to each nozzle in a column, which limits each nozzle set 404 to having no more than one nozzle from each nozzle column 402 for DBD testing at one time. Accordingly, there can be as many nozzle sets 404 as there are nozzles in a nozzle column 402. In some examples, a nozzle set 404 may not include a nozzle from each nozzle column 402. Thus, a nozzle set 404 may include one nozzle from every nozzle column 402, or it may include one nozzle from fewer than every nozzle column 402. In some examples, a nozzle set 404 may include one nozzle from a single nozzle column 402. For each nozzle column 402, there is a corresponding DBD test system 100 on printhead 304 to perform DBD tests on nozzles from within that column 402. Each DBD test system 100 can include a memory element 111 (FIG. 1*a*) such as a latch or storage register to store nozzle conditions, for example, in the form of logical output (i.e., binary output) converted from impedance and/or voltage values measured during a DBD test. The logical output stored in the register of a DBD test system 100 indicates the condition of a tested print nozzle. A communication bus 406 couples each DBD test system 100 to the nozzle management system 302 on printer 300 to enable the transfer of instructions, nozzle condition information, and other data between the printhead 304 and printer 300. In some examples, printhead 304 can include a single, cumulative register 408 on the printhead 304. A cumulative register 408 can store a nozzle condition that indicates at least one nozzle in a nozzle set 404 is not functioning properly. Thus, any nozzle from a nozzle set 404 determined to not function properly by its associated DBD test system 100 will cause the DBD system 100 to load the cumulative register 408 with logical output indicating the tested nozzle set 404 has a non-functioning nozzle.

Referring now primarily to FIGS. 3 and 4, the nozzle management system 302 on printer 300 includes a nozzle condition management module 334 stored in memory 330. Management module 334 comprises program instructions executable on processor 328 to cause printer 300 to retrieve, evaluate, and respond to nozzle conditions determined and stored in registers on printhead 304 by DBD test systems 100. The DBD testing of nozzles 102 is controlled by the execution of instructions in module 334 on a printer processor 328 that cause the printer 300 to send instructions to DBD test systems 100 on printhead 304 over communication bus 406. Instructions sent to a DBD test system 100 include, for example, instructions to enter a DBD test mode (e.g., enable DBD circuitry on the printhead), instructions to fire print nozzles in a specified nozzle set 404, and instructions to store DBD test results (i.e., nozzle condition results) in registers on the printhead 304. Module 334 executing on printer processor 328 further causes the printer 300 to wait for a short period of time after nozzles are fired to allow the DBD circuitry to store DBD test results (i.e., nozzle conditions) in registers (i.e., one register per nozzle column) on the printhead, and to thereafter read or retrieve the DBD results from the registers over a communication bus 406. Further executing instructions from module 334 on printer processor 328 can cause the printer 300 to evaluate the retrieved nozzle conditions and to provide varying responses, such as by adjusting future DBD tests. For example, if a nozzle condition indicates a nozzle is not functioning properly, the printer can respond by repeating the DBD tests on the same nozzle set 404 to continue an evaluation of the nozzle and to perhaps resolve an issue within the nozzle through the repeated firing. In other examples where an evaluation of the nozzle conditions from a tested nozzle set 404 indicate the nozzles are functioning properly, the printer can respond by instructing DBD test systems 100 to test different nozzle sets 404.

Figure 5:
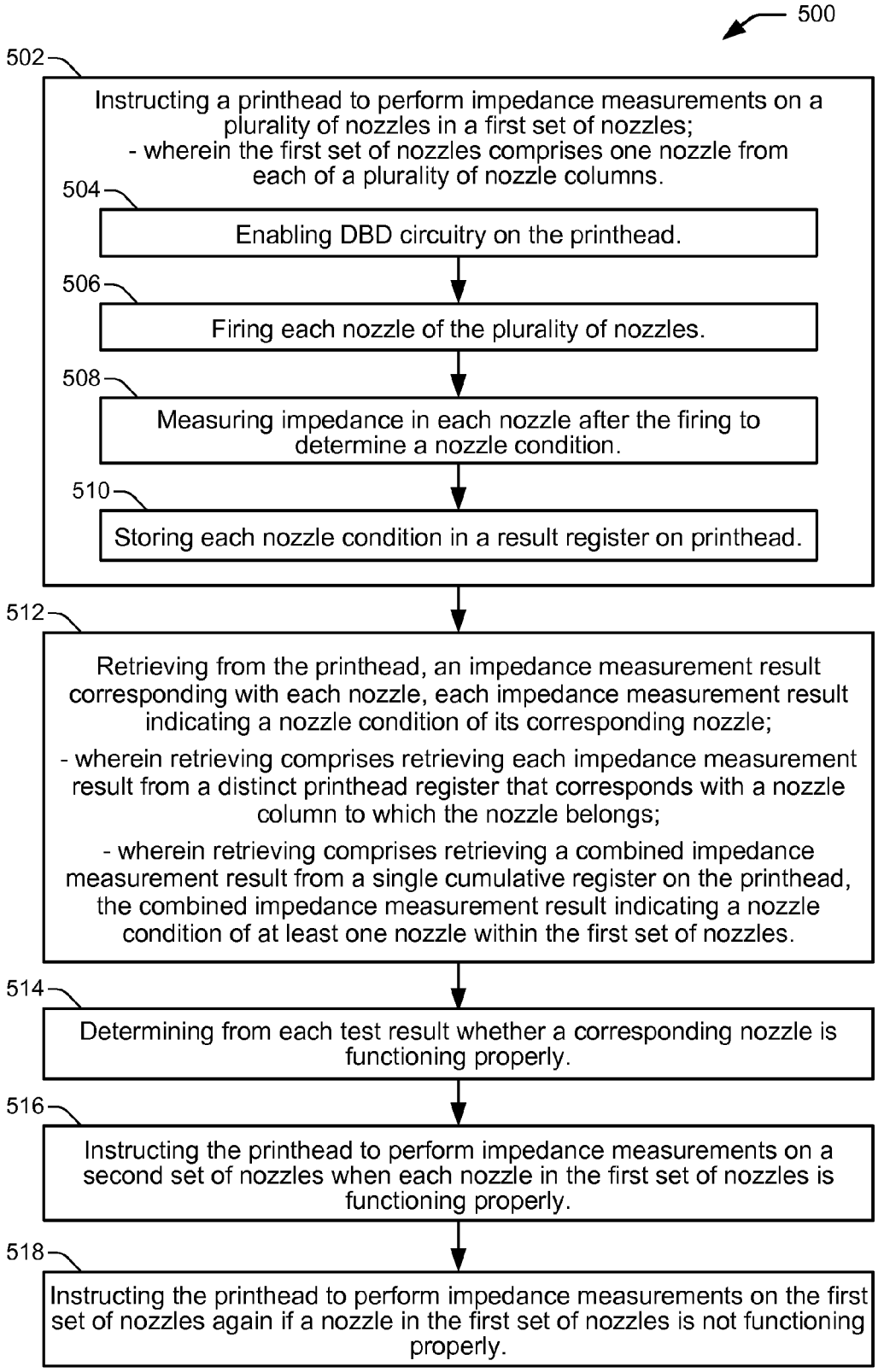
FIGS. 5 and 6 show flow diagrams that illustrate example methods related to managing nozzle condition tests on a printhead.
Figure 6:
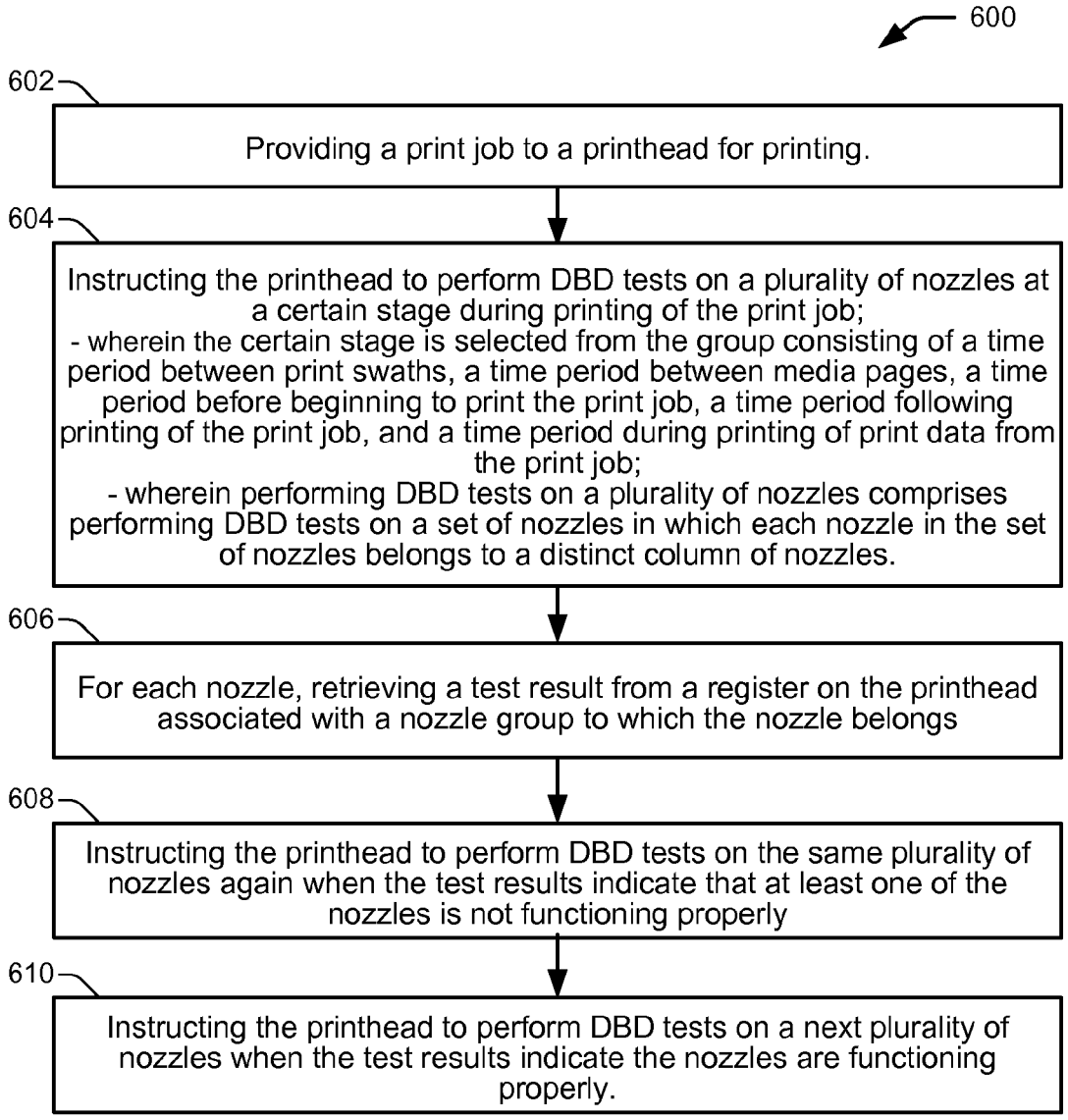

FIGS. 5 and 6 show flow diagrams that illustrate example methods 500 and 600, related to managing nozzle condition tests on a printhead. Methods 500 and 600 are associated with the examples discussed above with regard to FIGS. 1-4, and details of the operations shown in methods 500 and 600 can be found in the related discussion of such examples. The operations of methods 500 and 600 may be embodied as programming instructions stored on a non-transitory computer/processor-readable medium, such as memory 330 of a printer 330 as shown in FIG. 3. In some examples, implementing the operations of methods 500 and 600 can be achieved by a processor, such as processor 328 of FIG. 3, reading and executing the programming instructions stored in memory 330. In some examples, implementing the operations of methods 500 and 600 can be achieved using an ASIC 332 and/or other hardware components 334 alone or in combination with programming instructions executable by a processor.

Methods 500 and 600 may include more than one implementation, and different implementations of methods 500 and 600 may not employ every operation presented in the respective flow diagrams. Therefore, while the operations of methods 500 and 600 are presented in a particular order within the flow diagrams, the order of their presentation is not intended to be a limitation as to the order in which the operations may actually be implemented, or as to whether all of the operations may be implemented. For example, one implementation of method 500 might be achieved through the performance of a number of initial operations, without performing one or more subsequent operations, while another implementation of method 500 might be achieved through the performance of all of the operations.

Referring now to the flow diagram of FIG. 5, an example method 500 begins at block 502 with a printer instructing a printhead to perform impedance measurements on a plurality of nozzles in a first set of print nozzles. In some examples, the first set of nozzles comprises one nozzle from each of a plurality of nozzle groups, such as nozzle columns. As shown at blocks 504-510, instructing a printhead to perform impedance measurements can include enabling DBD circuitry on the printhead (504), firing each nozzle of the plurality of nozzles (506), measuring impedance in each nozzle after the firing to determine a nozzle condition (508), and storing each nozzle condition in a result register on the printhead (510). In some examples, storing each nozzle condition can included storing each nozzle condition in a separate result register on the printhead, or storing the nozzle condition of any non-functioning nozzle in a cumulative result register to indicate that at least one nozzle in the nozzle set is not functioning properly.

The method 500 can continue at block 512 with retrieving from the printhead, an impedance measurement result corresponding with each nozzle, where each impedance measurement result indicates a nozzle condition of its corresponding nozzle. In some examples, retrieving an impedance measurement result comprises retrieving each impedance measurement result from a distinct printhead register on the printhead that corresponds with a nozzle column to which the nozzle belongs. In some examples, retrieving an impedance measurement result comprises retrieving a combined impedance measurement result from a single cumulative register on the printhead, where the combined impedance measurement result indicates a nozzle condition of at least one nozzle within the first set of nozzles.

As shown at block 514 of method 500, each test result can be used to determine whether a corresponding nozzle is functioning properly. When each nozzle in the first set of nozzles is functioning properly, the printhead can be instructed to perform impedance measurements on a second set of nozzles, as shown at block 516. As shown at block 518, when a nozzle in the first set of nozzles is not functioning properly, the printhead can be instructed to perform impedance measurements on the first set of nozzles again.

Referring now to the flow diagram of FIG. 6, an example method 600 of managing nozzle conditions on a printhead begins at block 602 with a printer providing a print job to a printhead for printing. As shown at block 604, the printhead can be instructed by the printer to perform DBD tests on a plurality of nozzles at a certain stage during printing of the print job. In different examples, the certain stage can be a printing stage selected from the group consisting of a time period between printing print swaths, a time period between printing media pages, a time period before beginning to print the print job, and a time period following printing of the print job. In some examples, the certain stage can also be during real time printing of print data where DBD testing is performed on a nozzle fired while printing actual print data. Furthermore, in some examples, performing DBD tests on a plurality of nozzles comprises performing DBD tests on a set of nozzles in which each nozzle in the set of nozzles belongs to a distinct column of nozzles. The method 600 can continue as shown at block 606 with, for each nozzle, retrieving a test result from a register on the printhead associated with a nozzle group to which the nozzle belongs. As shown at block 608, the printhead can also be instructed to perform DBD tests on the same plurality of nozzles over again when the test results indicate that at least one of the nozzles is not functioning properly. The printhead can further be instructed to perform DBD tests on a next plurality of nozzles when the test results indicate the nozzles are functioning properly.

What is claimed is:

1. A method of managing a nozzle condition test on a printhead comprising:

instructing a printhead to perform impedance measurements on a plurality of nozzles in a first set of nozzles, the first set of nozzles comprising a single nozzle from each of a plurality of nozzle columns;

measuring impedance values for each nozzle in the first set of nozzles, the impedance values for each nozzle measured on the printhead with a sensor located within an ink chamber of each respective nozzle;

without communicating or processing impedance values or binary output signals off of the printhead, and by using logic circuitry on the printhead, converting the impedance values for each nozzle to a binary output signal that indicates a nozzle condition; and retrieving from the printhead, a binary output signal corresponding with each nozzle, each binary output signal indicating a nozzle condition of its corresponding nozzle.

2. A method as in claim 1, further comprising:

storing each binary output signal in a distinct printhead register that corresponds with a nozzle column to which the nozzle belongs, wherein retrieving a binary output signal comprises retrieving each binary output signal from the distinct printhead register that corresponds with a nozzle column to which the nozzle belongs.

3. A method as in claim 1, further comprising:

logically combining the binary output signals, wherein retrieving a binary output signal comprises retrieving a combined binary output signal from a single cumulative register on the printhead, the combined binary output signal indicating a nozzle condition of at least one nozzle within the first set of nozzles.

4. A method as in claim 1, further comprising:

instructing the printhead to perform impedance measurements on a second set of nozzles when each nozzle in the first set of nozzles is functioning properly, the second set of nozzles comprising a single different nozzle from each of the plurality of nozzle columns; and instructing the printhead to perform impedance measurements on the first set of nozzles again if a nozzle in the first set of nozzles is not functioning properly.

5. A method as in claim 1, wherein performing impedance measurements comprises:

enabling DBD circuitry on the printhead;

firing each nozzle of the plurality of nozzles;

measuring impedance in each nozzle after the firing to determine a nozzle condition; and storing each nozzle condition in a result register on the printhead.

6. A printer comprising:

a nozzle management system to initiate firing of nozzles within a specified nozzle set on a printhead, instruct drive bubble detect (DBD) systems on the printhead to test respective nozzles within the nozzle set for a presence and absence of a drive bubble at different time instants following the firing, and retrieve nozzle condition results stored on the printhead;

a drive bubble detect (DBD) module on a print die of the printhead coupled to a nozzle, the DBD module to register onto the print die, at a first predetermined time instant, an ink out test result obtained based on a voltage measured across the nozzle, and to determine a condition of the nozzle based on the ink out test result without communicating or processing the measured voltage or the ink out test result off of the printhead; and, a timing circuitry coupled to the DBD module to activate the DBD module at the first predetermined time instant to register the ink out test result.

7. A printer as in claim 6, further comprising a communication bus coupling the nozzle management system with each DBD system on the printhead to enable a transfer of instructions and nozzle condition results.

8. A non-transitory machine-readable storage medium storing instructions that when executed by a processor of a printing device, cause the printing device to:

provide a print job to a printhead for printing;

instruct the printhead to perform DBD tests on a plurality of nozzles at a certain stage during printing of the print job, the certain stage selected from the group consisting of a time period between print swaths, a time period between media pages, a time period before beginning to print the print job, a time period following printing of the print job, and a time period during printing of print data from the print job; and for each nozzle, retrieve a test result from a register on the printhead associated with a nozzle group to which the nozzle belongs.

9. A non-transitory machine-readable storage medium as in claim 8, wherein performing DBD tests on a plurality of nozzles comprises performing DBD tests on a set of nozzles in which each nozzle in the set of nozzles belongs to a distinct column of nozzles.

10. A non-transitory machine-readable storage medium as in claim 9, the instructions further causing the printing device to instruct the printhead to perform DBD tests on the same plurality of nozzles again when the test results indicate that at least one of the nozzles is not functioning properly.

11. A non-transitory machine-readable storage medium as in claim 9, the instructions further causing the printing device to:

instruct the printhead to perform DBD tests on a next plurality of nozzles when the test results indicate the nozzles are functioning properly.

* * * * *